US006669317B2

(12) United States Patent
Linder et al.

(10) Patent No.: US 6,669,317 B2
(45) Date of Patent: Dec. 30, 2003

(54) PRECURSOR ELECTRICAL PULSES TO IMPROVE INKJET DECEL

(75) Inventors: Thomas W. Linder, Corvallis, OR (US); Linda C. Uhlir-Tsang, Corvallis, OR (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 80 days.

(21) Appl. No.: 09/795,331

(22) Filed: Feb. 27, 2001

(65) Prior Publication Data

US 2002/0118237 A1 Aug. 29, 2002

(51) Int. Cl.[7] ..... B41J 29/38
(52) U.S. Cl. ..... 347/9; 347/10; 347/11
(58) Field of Search ..... 347/9, 10, 12, 347/13, 19, 26, 40, 48, 60, 11

(56) References Cited

U.S. PATENT DOCUMENTS 4,595,935 A * 6/1986 Brooks et al. ..... 346/76
4,746,935 A * 5/1988 Allen ..... 346/140
4,982,199 A * 1/1991 Dunn ..... 346/1.1
5,363,134 A * 11/1994 Barbehenn et al. ..... 347/49
5,477,246 A * 12/1995 Hirabayashi et al. ..... 347/12
5,907,337 A * 5/1999 Tajika et al. ..... 347/40
6,116,717 A * 9/2000 Anderson et al. ..... 347/19
6,126,270 A * 10/2000 Lebens et al. ..... 347/48
6,139,125 A * 10/2000 Otsuka et al. ..... 347/11
6,286,923 B1 * 9/2001 Sugahara ..... 347/10
6,286,924 B1 * 9/2001 Ahne et al. ..... 347/10
6,382,768 B1 * 5/2002 Koitabashi et al. ..... 347/48

* cited by examiner

*Primary Examiner*—Stephen D. Meier
*Assistant Examiner*—Lam Nguyen

(57) ABSTRACT

A print command is received and a short, single, electrical precursor pulse is generated to preheat the ink components near the surface of the heating element. The precursor pulse returns precipitated ink components near the resistor to solution. For best results, the precursor pulse occurs approximately 1.50 microseconds prior to the main drive pulse even though other times, such as 1.00 microsecond, can produce adequate results. The main drive pulse then occurs to print the required information.

21 Claims, 7 Drawing Sheets

PRECURSOR ELECTRICAL PULSES TO IMPROVE INKJET DECEL

TECHNICAL FIELD

The present invention relates generally to inkjet printing. More particularly, the present invention relates to changing the distribution characteristics of ink exiting the print head.

BACKGROUND OF THE INVENTION

Thermal inkjet printers operate by expelling a small volume of ink through a plurality of small nozzles or orifices in a print head surface that is in proximity to a printable medium. The nozzles are arranged in the surface of the print head such that the expulsion of a droplet of ink from a predetermined number of nozzles relative to a particular position of the print medium results in the printing of a portion of a desired character or image. Controlled repositioning of the print medium and/or printhead and another expulsion of ink droplets continues the production of more pixels of the desired character or image. Inks of selected colors may be coupled to individual arrangements of nozzles so that the selected firing of orifices can produce a multicolored image by the inkjet printer.

Expulsion of the ink droplet in a conventional thermal inkjet printer is a result of rapid thermal heating of the ink to a temperature that exceeds the boiling point of the ink solvent. The heating creates a gas-phase bubble of ink. Each nozzle is coupled to a small, unique ink firing chamber filled with ink that has an individually addressable heating element thermally coupled to the ink. This heating element is typically a resistor. As the bubble nucleates and expands, it displaces a volume of ink that is forced out of the nozzle and deposited on the print medium. The bubble then collapses and the displaced volume of ink is replenished from a larger ink reservoir by way of the ink feed channels.

The superheat temperature of the ink is the temperature at which the liquid ink undergoes a phase change from a liquid state to a gaseous state. The inks used in typical thermal inkjet printers have a superheat temperature in the range of 250° C. to 300° C.

After the deactivation of the heater resistor and the expulsion of ink from the firing chamber, ink flows back into the firing chamber to fill the volume vacated by the ink that was expelled. It is desirable to have the ink refill the chamber as quickly as possible to enable rapid firing of the nozzles of the print head. The faster the nozzles can fire, the faster the print speed that can be obtained.

Inks used in these types of print heads must have certain desirable characteristics. For example, inks that have a high decel characteristic cannot be used. Decel is the loss of drop velocity and weight that occurs during high speed firing of the print head. Inks that have a high decel reduce the print quality because of the misdirection and low drop weight of the ink drops. This is one cause of banding in the print output as well as other quality problems.

Various methods for improving the ink decel characteristic have been tried. For example, adding or removing components have shown improvements. However, changing the ink formulation in this manner compromises desirable ink properties such as ink stability and performance. Limited selections of inks, therefore, are available for inkjet use. There is a resulting unforeseen need to be able to use a larger range of inks in inkjet printers while still producing a high quality print output.

SUMMARY OF THE INVENTION

The present invention encompasses a process for reducing a decel characteristic of ink. The ink is part of an inkjet pen device that has a print head. The print head comprises heating elements that are coupled to the ink such that the electrical heating of the heating element causes the ink's temperature to increase.

When the printer receives a print command from a computer apparatus, the printer's controller generates a single, short, electrical pulse to the heating element. In the preferred embodiment, this pulse is less than 1 microsecond. In one embodiment, the pulse is in the range of 0.20–0.60 microseconds and occurs more than 1.00 microsecond prior to the product main drive pulse.

DETAILED DESCRIPTION OF THE PREFERRED EMBODIMENT

The present invention provides a higher quality print output by reducing the decel characteristics of liquid inks. By applying a precursor pulse to the heating resistor, the ink decel can be reduced by 50–90%.

Figure 1:
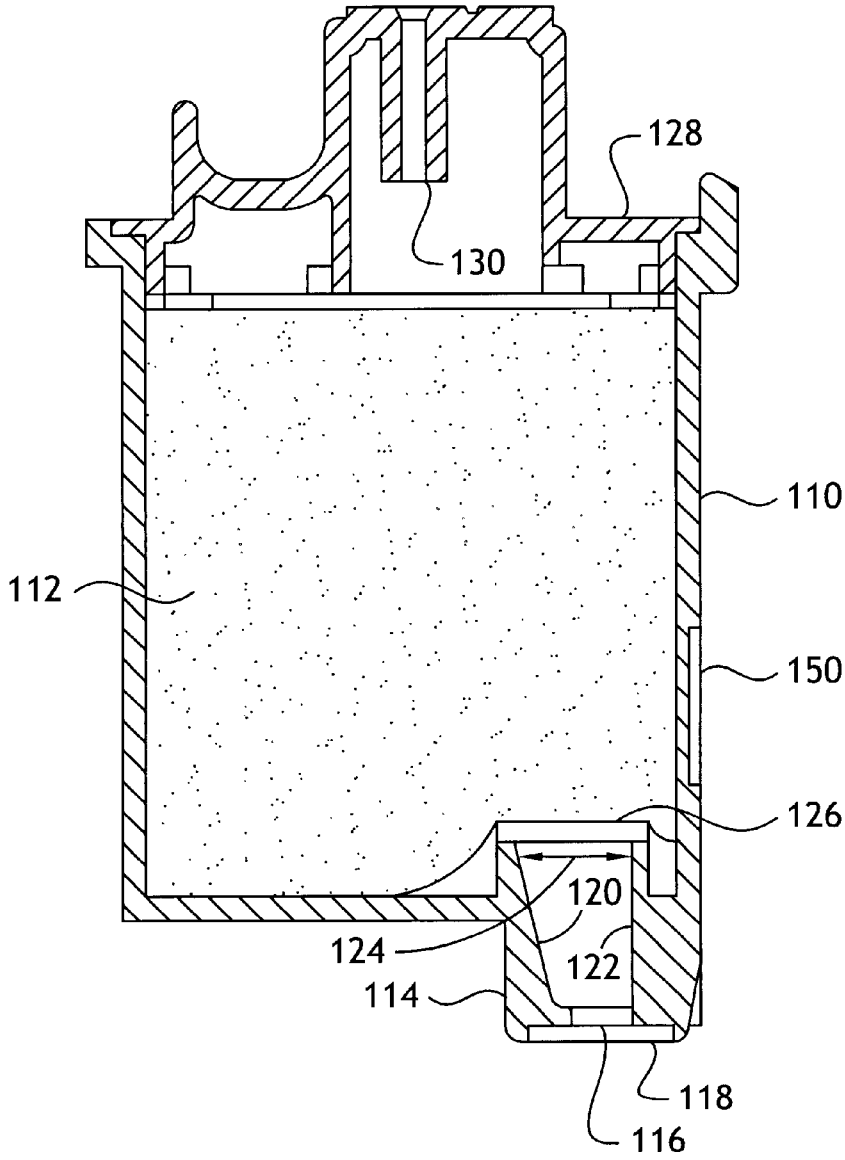
FIG. 1 shows a cross-sectional view of a thermal inkjet pen incorporating the print head of the present invention.

FIG. 1 illustrates a preferred embodiment thermal inkjet pen of the present invention. This inkjet pen includes a main unitary body housing (110) of a suitable plastic material. The housing (110) contains a reticulated polyurethane foam material (112) for storing the ink. The foam material (112) provides the necessary capillary backpressure at the print head of the pen to prevent ink from dripping out of the pen. This pen further includes an output or print head support section (114) that includes a small output opening (116) adjacent to which is mounted a thin film thermal inkjet print head (118). The print head support section (114) has interior walls (120 and 122) that define the contour of a large diameter standpipe and an air accumulating section (124).

As seen in FIG. 1, the air accumulating section (124) of the standpipe is the upper portion thereof just beneath the wire mesh filter (126). Air accumulates in this section (124) when the pen is operating in the orientation shown in FIG. 1. As a result of the wire mesh screen (126), air bubbles entering the standpipe from the print head are trapped. The screen (126) prevents air in the foam (112) from being drawn down into the standpipe.

The thermal inkjet pen also includes, in the preferred embodiment, an electrical connection (150). The electrical connection (150) provides the ability for signals from the inkjet printer in which the pen is place to communicate with the inkjet pen. Also in the preferred embodiment, the electrical connection (150) is comprised of a plurality of electrical contacts that enable the printer's controller to address each of the heating elements in the print head (118). This heating element addressing scheme is well known in the inkjet printing art and is not discussed further.

The present invention is not limited to the type of inkjet pen illustrated in FIG. 1. Alternate embodiments of the inkjet pen can include other types of inkjet pens or cartridges. The present invention encompasses any inkjet pen comprising an inkjet print head having means for heating the ink with electrical pulses.

Figure 2:
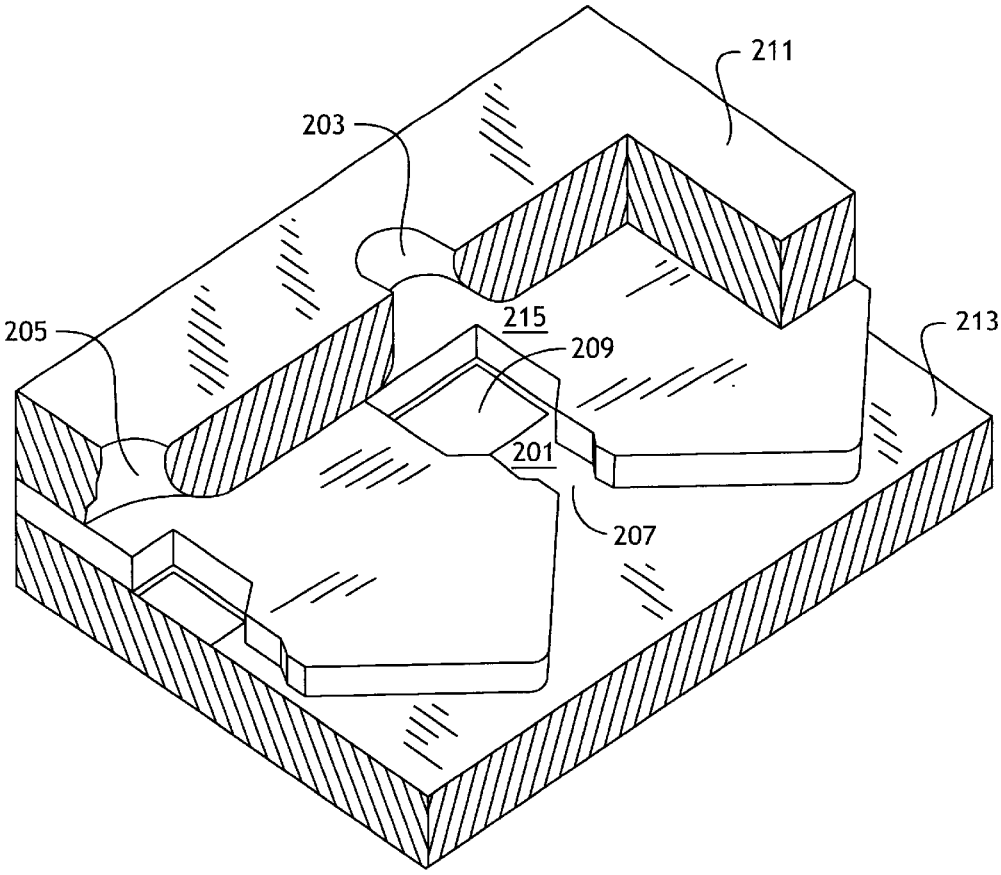
FIG. 2 shows an isometric view of an inkjet print head of the present invention.

A greatly magnified isometric view of a portion of the thermal inkjet print head (118) of the present invention is illustrated in FIG. 2. Several elements of the print head have been sectioned to reveal an ink-firing chamber (201) within the inkjet print head. Many such firing chambers are typically arranged in a group around an ink supply plenum for efficient and high quality printing. Additional groups may be located in the print head to allow for individual colors to be printed from each group.

Associated with each firing chamber (201) is an orifice (203) or nozzle that is relative to the firing chamber (201) so that the ink, which is rapidly heated in the firing chamber by a heater resistor (209), is forcibly expelled as a droplet from the orifice (203). Part of a second orifice (205), associated with another ink firing chamber, is also shown. In the preferred embodiment, these orifices (203 and 205) are on the order of 50 $\mu$m, or less, in diameter.

Figure 5:
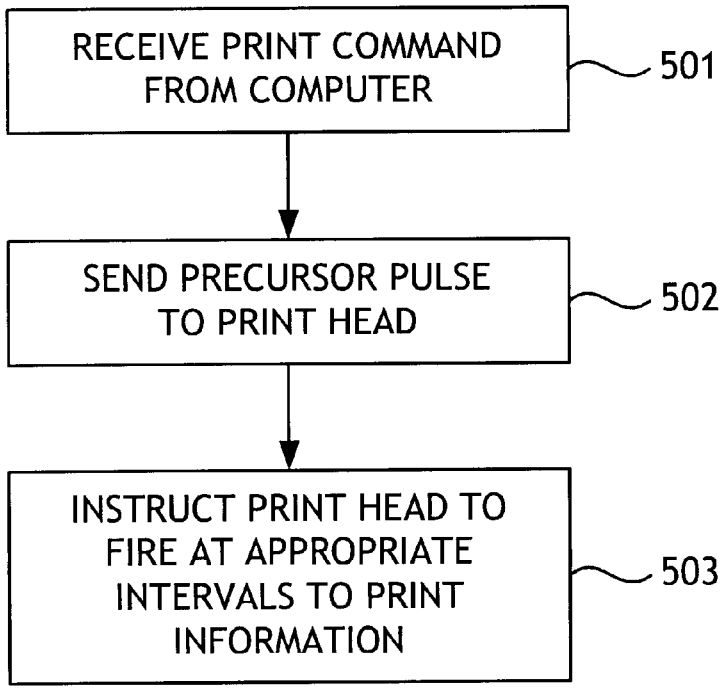
FIG. 5 shows a flow chart of the precursor electrical pulse process of the present invention.

The heater resistors are selected by a microprocessor and associated circuitry in the printer, discussed in association with FIG. 5, in a pattern related to the data entered to the printer. The ink is expelled from the selected orifices to create a defined character or figure on the print medium.

The print medium (not shown) is held parallel to the orifice plate (211) and perpendicular to the direction of the ink droplet expelled from the orifice (203). Ink is supplied to the firing chamber (201) via an opening (207) commonly referred to in the art as an ink feed channel. This ink is supplied to the ink feed channel (207) from a much larger ink reservoir, illustrated in FIG. 1, by way of an ink plenum that is common to all firing chambers in a group.

Once the ink is in the firing chamber (201), it remains there until it is rapidly heated to boiling by the heater resistor (209). In the preferred embodiment, the heater resistor (209) is a thin film resistance structure disposed on the surface of a silicon substrate (213) and connected to electronic circuitry of the printer by way of conductors disposed on the substrate (213). The heater resistor placement is typically staggered in three or more parallel lines of heater resistor with adjacent heater resistors placed non-colinearly. Print heads having increased complexity typically have some portion of the electronic circuitry constructed in integrated circuit form on the silicon substrate (213). Various layers of protection such as passivation layers and cavitation barrier layers of protection may further cover the heater resistor (209) to protect it from corrosive and abrasive characteristics of the ink. Thus, the ink-firing chamber (201) is bounded on one side by the silicon substrate (213) with its heater resistor (209) and other layers and bounded on the other side by the orifice plate (211) with its attendant orifice (203). The other sides of the firing chamber (201), as well as the ink feed channel (207), are defined by a polymer barrier layer (215).

The barrier layer (215), in the preferred embodiment, is made of an organic polymer plastic that is conventionally deposited upon the substrate (213) and its various protective layers. After deposition, the layer is photolithographically defined into desired geometric shapes and etched.

Polymers suitable for the purpose of forming a barrier layer (215) include products sold under the names PARAD, VACREL, and RISTON by E.I. DuPont De Nemours and Co. of Wilmington, Del. Such materials can withstand temperatures as high as 300° C. and have good adhesive properties for holding the orifice plate of the print head in position. In the preferred embodiment, the barrier layer (215) has a thickness of about 19 to 30 $\mu$m after the print head is assembled with the orifice plate (211).

The orifice plate (211) is secured to the silicon substrate (213) by the barrier layer (215). In the preferred embodiment, the orifice plate (211) is constructed of nickel with a plating of palladium (other cases: gold or rhodium) to resist the corrosive effects of the ink. The diameter of an orifice (203) in the orifice plate (211), in the preferred embodiment, is in the range of 25 to 52 $\mu$m.

Most types of ink experience a phenomenon referred to in the art as decel. Decel is the loss of drop velocity and weight due to high frequency firing of the ink nozzles. This phenomenon typically occurs when the firing of the nozzles is continuous over a time less than one second and where the frequency of firing is greater than 5 kHz. The decel characteristics of different colors of ink are illustrated in FIG. 3.

Figure 3:
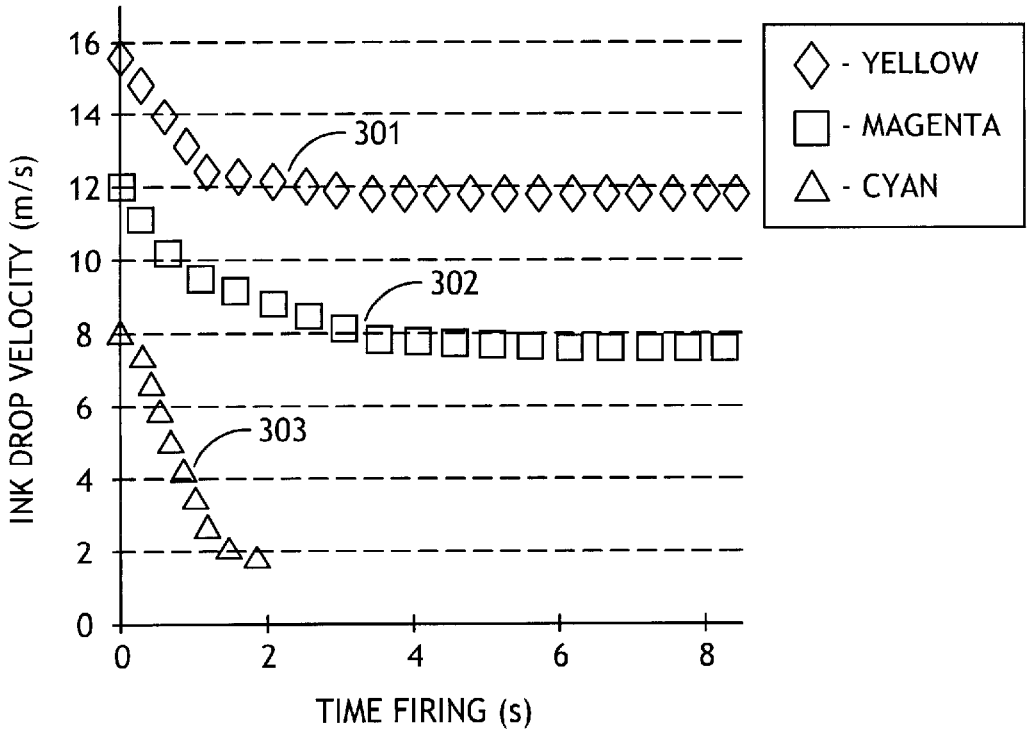
FIG. 3 shows a plot of a typical velocity versus time firing without the precursor pulses of the present invention.

FIG. 3 is a plot of the velocity of the ink drop, in meters per second, versus the time of firing, in seconds. The three most commonly used inks for ink pens are shown. These colors are yellow (301), magenta (302), and cyan (303). It can be seen that there is almost no decel experienced by yellow (301). Magenta (302) experiences a small amount of decel. Cyan (303) experiences the greatest amount of decel. In fact, the velocity of the cyan drops is reduced to half of the initial velocity by 0.40 seconds after printing has started.

The graph of FIG. 3 assumes a 9000 Hz rate of nozzle discharge and a 50° C. ambient print head temperature. Due to the heating method for firing the ink pen nozzles, the print head nozzles typically experience a higher ambient temperature than normal room temperature. Temperatures higher than 50° C. improve decel while lower temperatures make it worse.

The process and ink pen apparatus of the present invention provides a precursor electrical pulse prior to the main drive pulse. The main drive pulse is an electrical pulse of 1.0–2.0$\mu$sec. duration. The main drive pulse occurs whenever a drop of ink is required to be fired from the inkjet pen's nozzles. The main drive pulse, in the preferred embodiment, has an amplitude of less than 5.0 VDC.

Alternate embodiments use different amplitudes for the main drive pulse and the precursor pulse. Depending on the technology (e.g., CMOS, TTL) used to generate the pulses and the power supply, these voltages may be different from each other and/or different from 5.0 VDC.

In the preferred embodiment, the precursor pulse duration is substantially in the range of 0.20–0.60 $\mu$sec. and has an amplitude substantially the same as the main drive pulse. Also in the preferred embodiment, the precursor pulse occurs approximately 1.50 $\mu$sec. before each main drive pulse. The precursor pulse preheats the ink near the surface of the resistor to enable ink components that were shocked out of solution by previous main drive pulses to go back into solution just long enough to enable a full velocity firing.

Alternate embodiments of the present invention use other values of pulse duration that are substantially close to the preferred embodiment range may reduce ink decel an appropriate amount to improve print quality. Also, a pulse that occurs substantially close to 1.00 μsec. before the product main drive pulse may provide enough of a decel improvement for adequate print quality.

Figure 4:
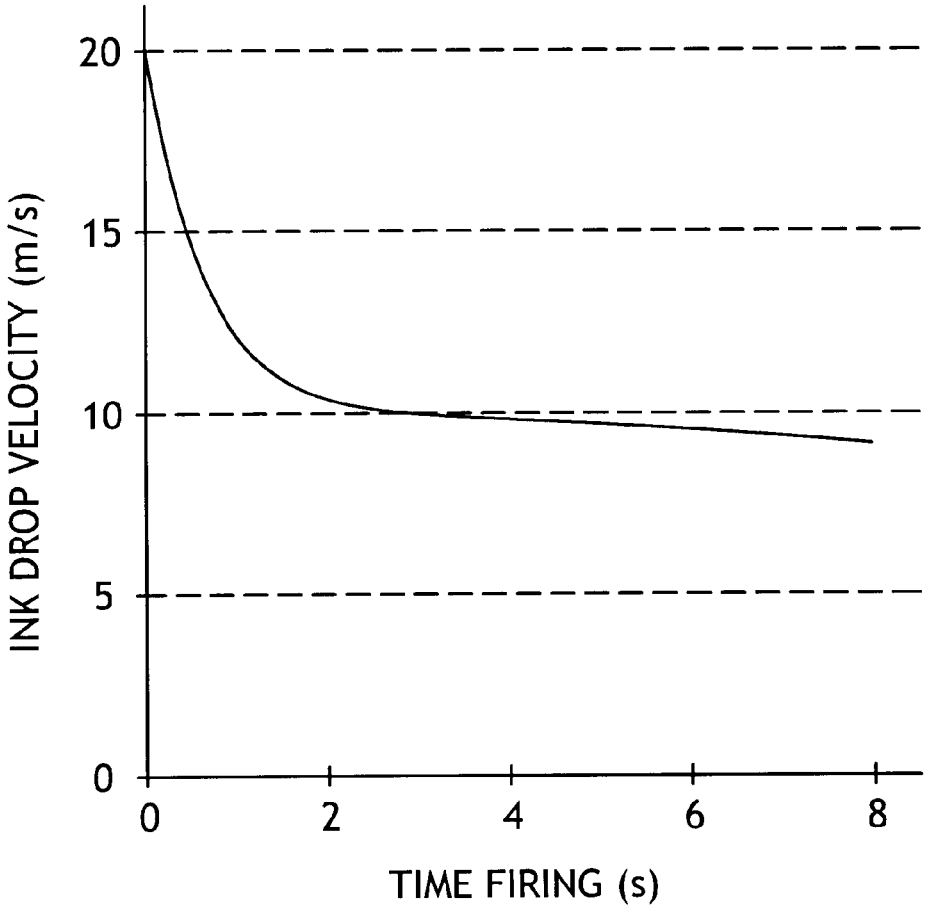
FIG. 4 shows a plot of a plot of velocity versus time firing with the precursor pulses in accordance with the present invention.

FIG. 4 illustrates a plot of the ink drop velocity versus time firing using the precursor pulse process of the present invention. The plot of FIG. 4 illustrates only the color cyan since it experienced the worst decel prior to the precursor pulse. This plot shows that the decel has been greatly reduced over the prior art method of nozzle firing.

FIG. 5 illustrates a flowchart of the precursor pulse process of the present invention. The process starts by receiving a print command (step 501) from the computer that is coupled to the printer. The print command also includes the information to be printed by the inkjet printer.

The inkjet printer's controller then controls the power provided to the print head in order to generate the precursor pulse (step 502) at least 1.50 μsec. prior to the main drive pulse. Next, the controller provides the necessary switching of the power to the print head in order to fire the appropriate print nozzles at the proper time in order to print the information from the computer.

Figure 6:
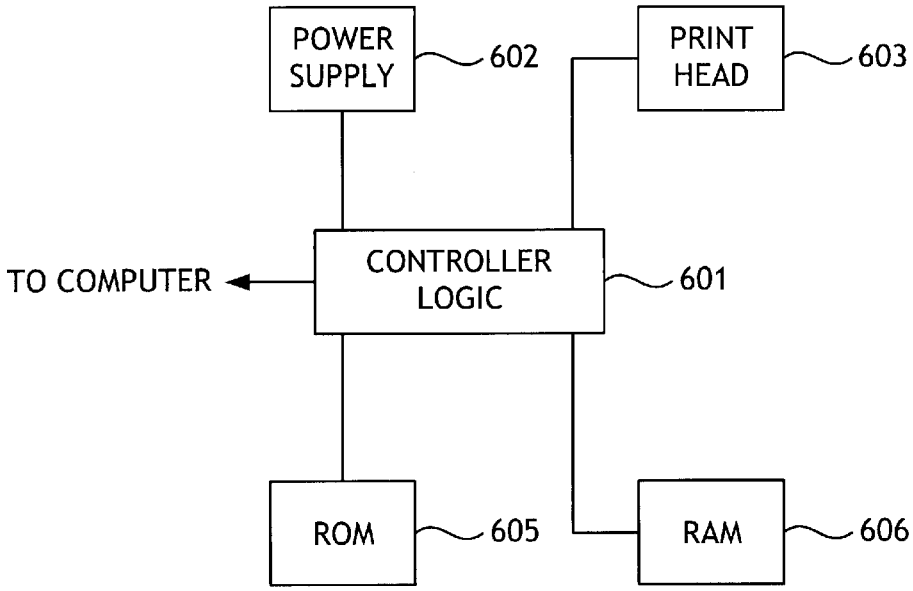
FIG. 6 shows a block diagram of a printer system in accordance with the present invention.

FIG. 6 illustrates a block diagram of the inkjet printer apparatus of the present invention. The inkjet printer is controlled by a controller logic (601) that uses the precursor pulse process of the present invention. This controller, in the preferred embodiment is a microprocessor such as a MOTOROLA 6800. Other types of microprocessors or microcontrollers are used in alternate embodiments. Additional embodiments use discrete logic or programmable logic that act as a controller.

The controller logic (601) is coupled to a computer device such as an APPLE G3 or other such device. In alternate embodiments, the computer device can be a personal digital assistant or any other computer-like device that has the ability to send print commands.

The controller logic (601) is coupled to memory such as ROM (605) and RAM (606). The ROM (605) stores the permanent instructions to be executed by the controller logic (601) in operating the inkjet pens as well as moving the inkjet pens and print medium to their respective proper locations in order to print a document as required by the computer attached to the printer apparatus. The RAM (606) is used to store the document or other information to be printed by the printer. The RAM (606) can also be used to store temporary data used by the controller. In alternate embodiments, the RAM (606) is not required as the memory in the computer device coupled to the inkjet printer apparatus is used to store the required information.

A power supply (602) provides the required voltage levels for the controller (601) as well as the rest of the components of the inkjet printer apparatus. Different embodiments require different voltage levels.

The controller logic (601) provides the addressing capability to access each resistor in the print head (603). The controller logic (601) also generates the required precursor and main drive pulses of the present invention. The timing of the precursor pulses and the main drive pulses are all controlled by the controller logic (601).

Figure 7:
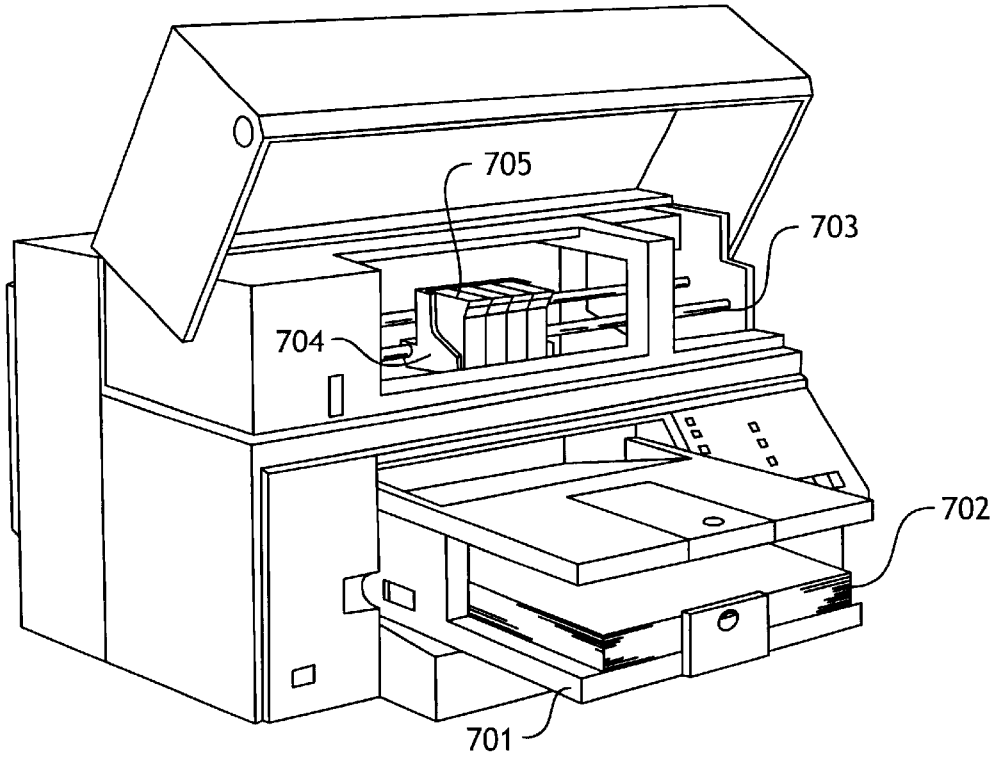
FIG. 7 shows an inkjet printer in accordance with the present invention.

FIG. 7 illustrates an inkjet printer that uses the inkjet pen and electrical precursor pulse of the present invention. The printer is comprised of a print medium holder (701) in which the print medium (702) rests. In one embodiment, the print medium is paper.

One or more inkjet pens (705) that use the precursor pulse in the present invention are installed in an inkjet penholder (704). The inkjet penholder slides along a track (703) that is built into the printer for purposes of allowing the inkjet pen to print across substantially the entire width of the print medium.

The inkjet pen may hold a single color, such as black, or multiple colors. These colors, in the preferred embodiment, include yellow, magenta, and cyan. Alternate embodiments use other colors and other combinations of colors.

In the preferred embodiment, the inkjet printer of FIG. 7 is coupled to a computer. The computer provides the information that is to be printed. This information can be transmitted to the inkjet printer over a parallel or serial bus. In the preferred embodiment, the computer is a personal computer that runs an operating system such as MACINTOSH or WINDOWS. Alternate embodiments use other types of computers including personal digital assistants or mainframe computers.

The printer's controller provides the commands to the print head to activate the inkjet pen's nozzles at the appropriate time to print the information on the desired medium. The printer's controller is also responsible, according to the process illustrated in FIG. 5, for controlling the precursor pulses to the print head in order to reduce the decel characteristic of the ink.

In summary, the present invention reduces the decel characteristics of ink by generating a single, electrical, precursor pulse, with a duration of 0.20–0.60 μsec. more than 1.00μsec. prior to the main drive pulse. This reduces the decel by 50–90%. By reducing the decel in all inks, a wider range of inks can be used that were previously excluded due to high decel characteristics.

Numerous modifications and variations of the present invention are possible in light of the above teachings. It is therefore to be understood that within the scope of the appended claims, the invention may be practiced otherwise than as specifically described herein.

What is claimed is:

1. A method for reducing a decel characteristic of ink that is part of an inkjet pen device, the inkjet pen device comprising a print head having heating elements that are coupled to the ink, the method comprising the steps of:

receiving a print command from a computer apparatus;

generating a main drive pulse in response to the print command;

generating a single, electrical pulse to the heating element in response to the print command, the single, electrical pulse being configured to limit a loss of drop velocity and weight of ink ejected from the inkjet pen due to high-frequency firing of the inkjet pen continuously over a period of time, wherein the single, electrical pulse occurs prior to the main drive pulse, and has a duration that is less than one microsecond and is based on the color of ink ejected from the inkjet pen.

2. The method of claim 1 wherein the print command is received by an inkjet printer controller that is coupled to the print head.

3. The method of claim 1 wherein the step of generating includes generating the single, electrical pulse with a duration in a range of 0.20 to 0.60 milliseconds.

4. The method of claim 2 and further comprising the step of the inkjet printer controller switching power on and off to the print head in order to generate the single, electrical pulse.

5. The method of claim 1 wherein the step of generating includes generating the single, electrical pulse substantially close to 1.00 microsecond prior to the main drive pulse.

6. The method of claim 1, wherein the single, electrical pulse has a duration which is generally in the order of 20% of the duration of the main drive pulse.

7. An inkjet printing apparatus for reducing a decel characteristic of ink, the apparatus comprising:

an inkjet pen that contains ink having a decel characteristic, the inkjet pen comprising an ink reservoir for containing the ink and a heating element, coupled to the ink, for heating the ink at predetermined times in order to expel ink from the inkjet pen;

a power supply, coupled to the controller, for generating a predetermined voltage level; and controller logic, coupled to the power supply, for causing a single electrical pulse to be applied to the heating element prior to start of printing, such pulse being selected based on color of ink in the inkjet pen to limit a loss of drop velocity and weight in ink expelled from the inkjet pen due to high frequency firing of the inkjet pen continuously over a period of time.

8. The inkjet printing apparatus of claim 7 wherein the controller logic includes means for causing power to be applied to the heating element as a main drive pulse in response to a print command.

9. The inkjet printing apparatus of claim 8 wherein the controller logic includes means for causing power to be applied to the heating element as the single electrical pulse having a duration in the range of 0.20–0.60 microseconds and occurring at least 1.00 microsecond prior to the main drive pulse.

10. The inkjet printing apparatus of claim 7 and further including memory, coupled to the controller logic, for storing information to be printed by the printing apparatus.

11. The inkjet printing apparatus of claim 7 wherein the inkjet pen further comprises a print head on which the heating element is coupled.

12. The inkjet printing apparatus of claim 11 wherein the print head further comprises a silicon substrate and the heating element comprises a thin film resistor that is etched into the substrate, the thin film resistor being coupled to the controller logic whereby the electrical pulses controlled by the controller logic heats the thin film resistor enough to boil the ink that is coupled to the thin film resistor thus expelling the ink through an opening in the print head in order to print desired information.

13. An inkjet pen for improving a decel characteristic of ink contained within the inkjet pen, the inkjet pen comprising:

an ink reservoir for holding the ink;

a print head, coupled to the ink reservoir, the print head comprising:

a silicon substrate into which are etched a plurality of heating elements, the plurality of heating elements coupled to and receiving a precursor pulse and a main drive pulse, the precursor pulse having a duration in the range of 0.20 to 0.60 microseconds based on the ink in the ink reservoir and occurring substantially close to 1.00 microsecond before the main drive pulse, thereby producing a time interval between the end of the precursor pulse and the start of the main drive pulse in the range of 0.40 to 0.80 microseconds and the main drive pulse having a duration in the range of 1.0 to 2.0 microseconds;

a barrier layer, coupled to the silicon substrate, having an opening over each heating element and a firing chamber adjacent to the heating element and an orifice plate, coupled to the barrier layer, in which an orifice is present over each heating element;

wherein the ink is forced into a liquid state by the precursor pulse before the main drive pulse heats the heating element and boils the ink to force it out the orifice over the first heating element, thereby limiting a loss of drop velocity and weight in ink expelled from the inkjet pen due to high-frequency firing of the inkjet pen continuously over a period of time.

14. The inkjet pen of claim 13 wand further including an electrical contact plate, coupled to one side of the inkjet pen, to enable a controller to communicate with the print head.

15. The inkjet pen of claim 14 wherein the electrical contact plate includes a plurality of contacts enabling the controller to address each resistor in the print head.

16. The inkjet pen of claim 13 and further including a standpipe coupling the ink reservoir to the print head.

17. The inkjet pen of claim 13 wherein the main drive pulse is applied to the heating elements in response to a print command from the controller.

18. The inkjet pen of claim 17 wherein the main drive pulse is in the range of 1.0 to 2.0 microseconds in duration.

19. The inkjet pen of claim 13 wherein the main drive pulse and the precursor pulse have substantially the same amplitude.

20. The inkjet pen of claim 13 wherein the precursor pulse occurs 1.50 microseconds prior to the main drive pulse.

21. The inkjet pen of claim 13 wherein the main drive pulse and the precursor pulse have different amplitudes.

* * * * *